US011421517B2

(12) United States Patent
Perez et al.

(10) Patent No.: US 11,421,517 B2
(45) Date of Patent: Aug. 23, 2022

(54) FLUID DIVERSION USING DEPLOYABLE BODIES

(71) Applicants: Juan Carlos Flores Perez, The Woodlands, TX (US); Edward O'Malley, Houston, TX (US)

(72) Inventors: Juan Carlos Flores Perez, The Woodlands, TX (US); Edward O'Malley, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 96 days.

(21) Appl. No.: 16/856,519

(22) Filed: Apr. 23, 2020

(65) Prior Publication Data

US 2021/0332682 A1 Oct. 28, 2021

(51) Int. Cl.
*E21B 43/26* (2006.01)
*E21B 33/12* (2006.01)

(52) U.S. Cl.
CPC ..... *E21B 43/26* (2013.01); *E21B 33/12* (2013.01)

(58) Field of Classification Search
CPC ..... E21B 43/26; E21B 33/12; C09K 8/00; C09K 8/0342; C09K 8/424; C09K 8/426
USPC ..... 166/305.1
See application file for complete search history.

(56) References Cited

U.S. PATENT DOCUMENTS 5,253,709 A 10/1993 Kendrick et al.
10,378,303 B2 * 8/2019 Hayter ..... E21B 33/12
10,415,344 B2 * 9/2019 Jacob ..... E21B 33/1208
11,028,687 B2 * 6/2021 Fripp ..... E21B 33/13
11,125,047 B1 * 9/2021 Rosenholm ..... C09K 8/516
2009/0101334 A1 4/2009 Baser et al.
2014/0345878 A1 11/2014 Murphree et al.
2015/0159462 A1 * 6/2015 Cutler ..... E21B 34/14 166/377

(Continued)

FOREIGN PATENT DOCUMENTS

WO 2016056934 A1 4/2016

OTHER PUBLICATIONS

International Search Report for Intemation Application No. PCT/US2021/028627; International Filing Date Apr. 22, 2021; dated Aug. 12, 2021.

(Continued)

*Primary Examiner* — Matthew R Buck
*Assistant Examiner* — Patrick F Lambe
(74) *Attorney, Agent, or Firm* — Cantor Colburn LLP

(57) ABSTRACT

A system for diverting fluid in a borehole string includes an object configured to be deployed in the borehole string. The borehole string includes a plurality of fluid ports defining a plurality of zones along a length of the borehole string, each fluid port extending from a fluid conduit in the borehole string to at least one of: an annular region of the borehole string and a subterranean region. The object is configured to be advanced by a fluid to a fluid port to obstruct the fluid port and divert the fluid in the borehole string to another fluid port. The object includes a core portion made from a first material having a first property, and an outer portion at least partially surrounding the core portion and made from a second material, the second material being deformable and having a second property that is different than the first property.

20 Claims, 7 Drawing Sheets

(56) References Cited

U.S. PATENT DOCUMENTS

| | | | | |
|---|---|---|---|---|
| 2018/0171745 | A1* | 6/2018 | Jones | E21B 43/16 |
| 2018/0216438 | A1 | 8/2018 | Sewell | |
| 2020/0102804 | A1* | 4/2020 | Frazier | E21B 23/0413 |

OTHER PUBLICATIONS

Written Opinion for International Application No. PCT/US2021/028627; International Filing Date Apr. 22, 2021; dated Aug. 12, 2021.

* cited by examiner

Density Eccentered

FLUID DIVERSION USING DEPLOYABLE BODIES

BACKGROUND

In the resource recovery industry, exploration and production of hydrocarbons and other resources may require a number of diverse activities from various engineering fields to be performed in a borehole penetrating an earth formation. Hydrocarbon exploration generally involves activities such as drilling, installing permanent installations, formation evaluation, casing perforation, and stimulation such as hydraulic fracturing and chemical injection.

In some operations, it is beneficial to be able to divert or otherwise control the flow of fluid in a borehole. For example, during hydraulic fracturing and other stimulation operations, a stimulation fluid is injected into a borehole and directed to a subterranean region in order to stimulate the production of hydrocarbons. In some cases, differences in formation properties along a borehole can result in uneven stimulation. As a result, it is desirable to divert the flow of fluid from high flow rate zones in a subterranean region to other regions to improve stimulation outcomes.

SUMMARY

An embodiment of a system for diverting fluid in a borehole string includes an object configured to be deployed in the borehole string. The borehole string includes a plurality of fluid ports defining a plurality of zones along a length of the borehole string, each fluid port extending from a fluid conduit in the borehole string to at least one of: an annular region of the borehole string and a subterranean region. The object is configured to be advanced by a fluid to a fluid port to obstruct the fluid port and divert the fluid in the borehole string to another fluid port. The object includes a core portion made from a first material having a first property, and an outer portion at least partially surrounding the core portion and made from a second material, the second material being deformable and having a second property that is different than the first property.

An embodiment of a method of diverting fluid in a borehole string includes injecting a fluid into a fluid conduit of the borehole string, the borehole string including a plurality of fluid ports defining a plurality of zones along a length of the borehole string. Each fluid port extends from a fluid conduit in the borehole string to at least one of: an annular region of the borehole string and a subterranean region, where the injecting includes flowing the fluid through one or more fluid ports into the subterranean region. The method also includes deploying an object into the borehole string and advancing the object by the fluid to a fluid port to obstruct the fluid port and divert the fluid in the borehole string to another fluid port. The object includes a core portion made from a first material having a first property, and an outer portion at least partially surrounding the core portion and made from a second material, the second material being deformable and having a second property that is different than the first property.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
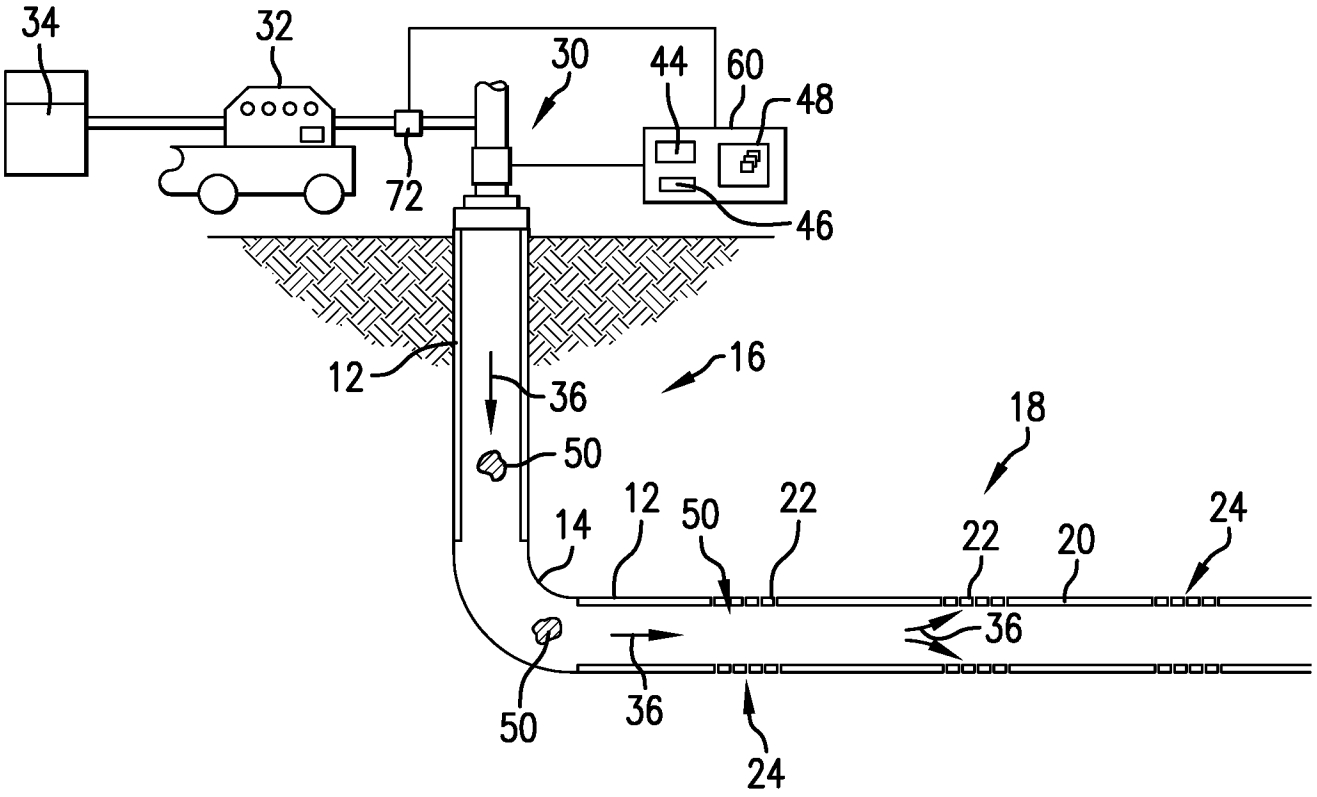
FIG. 1 depicts an embodiment of a system for performing subterranean operations, including stimulation operations.

A detailed description of one or more embodiments of the disclosed apparatus and method are presented herein by way of exemplification and not limitation with reference to the Figures.

Systems, devices and methods are provided herein for diverting fluid in a borehole and/or during a subterranean operation. An embodiment of a fluid diversion system includes or is configured to utiliize one or more deployable bodies that can be pumped, dropped or otherwise deployed and transported via a fluid to a selected borehole location. For example, the bodies can be deployed by pumping the bodies with fluid, such as fracturing or stimulation fluid, to a selected depth or location.

Each deployable body includes portions or components made from at least two materials that have different properties. In one embodiment, the properties include mechanical and/or chemical properties, such as material composition, harness, elasticity, strength and others. For example, each deployable body includes a core portion made from a first material and an outer portion that at least partially surrounds the core portion and is made from a second material. The first (core) material has at least one property, such hardness, mechanical strength and/or rigidity, that is greater (or otherwise different) than a corresponding property of the second (outer) material. The deployable body may be spherical, oblong, elongated, flat or have any other selected size and/or shape. It is noted that reference to a "material" is intended to encompass a single material or a combination of multiple materials. For example, the first and/or second material may be a composite material, a composition of multiple materials, and/or multiple layers of various materials.

The outer portion, in one embodiment, is a deformable portion made from a material that can deform upon engagement with a fluid passage. For example, the deployable object is sized and shaped based on sizes and/or shapes of perforations or other fluid passages that provide fluid communication between a fluid conduit in a borehole string and an annular region of a borehole (and/or a subterranean region surrounding the borehole). When a deployable object is inserted into a borehole during a fracturing or other fluid injection operation, borehole fluid is drawn through a perforation, which draws the object into engagement with the perforation. The body adapts and conforms to the shape and irregularities of the perforation to block off flow through the perforation.

Embodiments described herein provide a number of advantages and technical effects. Currently, bodies such as diverter pods and rope knots covered with wax are used to divert fluid during a fracturing operation by plugging perforations or other fluid ports through which fracturing fluid is applied to a formation or subterranean region. Such bodies can be unreliable (e.g., in plug size, pressure differential rating) and also can present a challenge when milling, as some diverter bodies can thread into a drill bit and reduce efficiency.

FIG. 1 illustrates an embodiment of a system 10 for performing subterranean operations and/or energy industry operations, such as a stimulation, completion, measurement and/or hydrocarbon production system 10. The system 10 includes a borehole string 12, such as a production string, that is configured to be disposed in a borehole 14 that penetrates a resource bearing formation 16 or other subterranean region.

In one embodiment, the borehole 14 and the system 10 are configured to perform a stimulation operation. The stimulation operation, in one embodiment, includes injecting a treatment fluid to increase production from the formation 16. Various stimulation fluids may be injected, such as water, chemical compositions (e.g., acids), hydraulic fracturing fluid, proppant and/or others. For example, the borehole string 12 includes a multi-stage stimulation system 18 that includes a casing or liner 20 having a plurality of fluid ports 22. The fluid ports can be, for example, holes or ports formed as part of the liner 20 or perforations formed by perforating guns. The stimulation assembly may include additional components such as bridge plugs to facilitate fracturing the formation.

In one embodiment, the fluid ports 22 are perforations through the liner 20 that are arrayed in clusters 24. Individual clusters may define individual stages, or multiple clusters may be part of a single stage. Stages may be isolated from one another using bridge plugs, packers and/or other components.

Although the stimulation assembly 18 is shown as including a liner or casing, the system is not so limited. The system 10 may be configured to perform open hole fracturing, e.g., by deploying a fracturing string including tubing, packers, frac sleeves and/or other suitable components.

Various components may be configured to communicate with a surface location and/or a remote location, for example, via one or more conductors (e.g., hydraulic lines, electrical conductors and/or optical fibers) and/or wireless telemetry (e.g., mud pulse, electromagnetic, etc.)

The system 10 also includes surface equipment 30 such as a drill rig, rotary table, top drive, blowout preventer and/or others to facilitate deploying the borehole string 12 and/or controlling downhole components. For example, the surface equipment 30 includes a fluid control system 32 including one or more pumps in fluid communication with a fluid tank 34 or other fluid source.

In one embodiment, the system 10 includes a processing device such as a surface processing unit 40, and/or a subsurface processing unit disposed in the borehole 14 and connected to one or more downhole components. The surface processing unit 40, in one embodiment, includes a processor 44, an input/output device 46 and a data storage device (or a computer-readable medium) 48 for storing data, files, models, data analysis modules and/or computer programs. The processing device may be configured to perform functions such as controlling downhole components, controlling fluid circulation and/or fluid injection (e.g., controlling and/or communicating with the fluid control system 32), monitoring components during deployment, transmitting and receiving data, processing measurement data and/or monitoring operations. For example, the storage device 48 stores processing modules for performing one or more of the above functions.

During a fracturing operation, stimulation fluid 36 such as a fracturing slurry is prepared by mixing fracturing fluid (from, e.g., the fluid tank 34) with proppant and injecting the fracturing slurry through the perforations 22 to cause fractures to form and/or to extend previously stimulated or natural fractures.

The formation 16 may have characteristics that vary along different regions or zones in the formation. For example, some zones may have higher porosity or permeability, and thereby draw more fracturing fluid than less permeable zones. In addition, fractures formed along the borehole may have different lengths, widths, numbers and other characteristics. As a result, high productively zones can disproportionally draw stimulation fluid, and less productive zones may not be fractured to a desired extent, resulting in lower production than would otherwise be possible.

An operator and/or control system (e.g., the surface processing unit 40) can perform a diversion operation by deploying an object or objects with injected fluid to at least partially block fluid from entering certain zones. Each deployable object includes a core portion made from a first material (or combination of materials) having a first material property (e.g., hardness). Each deployable object also includes a deformable outer portion that at least partially surrounds the core portion. The outer portion is made from a second material that has a different property than the first material. For example, the core portion is made from a material having a greater hardness and/or mechanical strength than the outer portion. The outer portion can thus deform to conform to the shape of a fluid passage (e.g., fluid port 22) or multiple fluid passages.

The system 10 includes a system or mechanism for diverting fluid, that includes or employs one or more deployable bodies, also referred to as plugs. A "plug" is intended to refer to any mass or body that can be pumped, dropped or otherwise deployed downhole with fluid and at least partially blocks a fluid passage. The plugs can take any suitable form, such as pods, balls, discs, darts and others.

For example, during a fracturing or other stimulation operation, one or more plugs 50 are deployed with the stimulation fluid 36, such as a fracturing slurry. The plugs 50 flow with the stimulation fluid 36 through a production conduit in the borehole string 12. Based on the pressure differential between fluid in the production conduit and fluid pressure in the formation, the fluid 36 flows through the production conduit and the fluid ports 22, and into the formation 16. The plugs 50 are drawn into engagement with one or more of the fluid ports 22. For example, some zones draw more fracturing fluid due to, for example, higher permeability, higher porosity and/or larger fractures. The relatively high flow rates and differential pressure causes more fluid to be drawn into some zones and thereby deprive other zones of sufficient fluid to effectively create and/or extend fractures. The plugs 50 are drawn to the higher flow rate zones and into engagement with respective fluid ports 22 and/or clusters, thereby restricting fluid flow therethrough and causing fluid to be diverted to other zones.

Although the embodiments are discussed in conjunction with the perforated casing shown in FIG. 1, the embodiments are not so limited. For example, fluid passages may be flow ports in sliding sleeves or frac sleeves.

Figure 2:
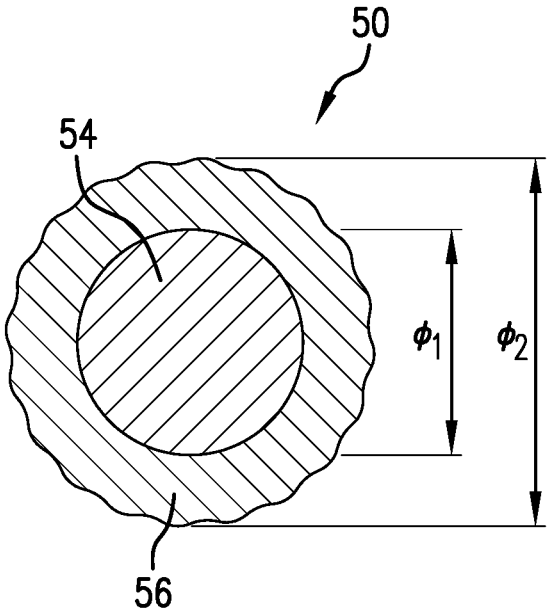
FIG. 2 depicts an embodiment of a deployable body configured to restrict fluid flow through one or more fluid passages

FIG. 2 illustrates an embodiment of a deployable body or plug 50, which includes a core portion 54 and an outer portion 56. The outer portion 56 may completely surround the core portion 54, as is shown in FIG. 2, or the outer portion 56 surrounds part of the core portion.

The plug 50 is made from at least two types of materials, i.e., materials having at least one different property. For example, the core portion 54 is made from a first material having a first property, such as a level of hardness, and the outer portion 56 is made from a material having a different property, such as a lower level of hardness than the first property.

Figure 3:
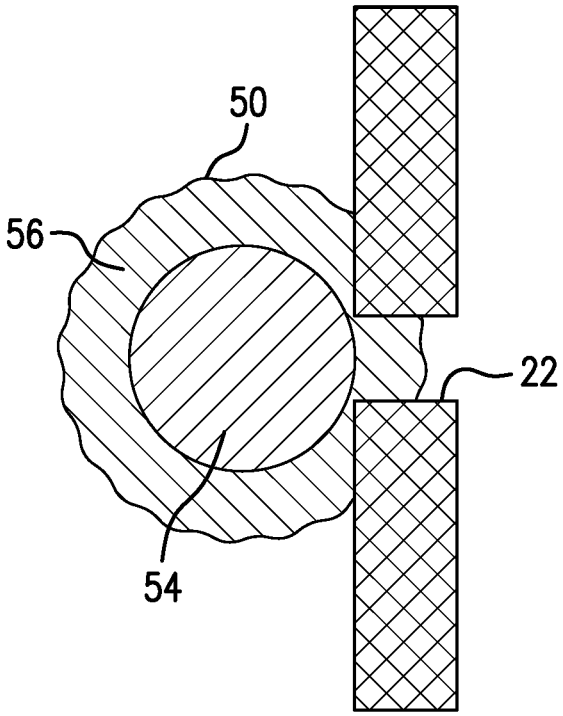
FIG. 3 depicts the deployable body in engagement with a fluid passage, such as a fluid port or perforation.

FIG. 3 shows the plug 50 in engagement with a perforation or other fluid passage 22. As the plug 50 is drawn with fluid, the outer portion 56 conforms and adapts to the shape of the fluid port 22 and any irregularities in the fluid port 22. The core portion 54 contacts or is proximate to the fluid port, and substantially retains its shape and is held in place at least by differential pressure. In this embodiment, the core portion 54 has a diameter that is greater than the size or diameter of the fluid port 22.

The core portion 54 may be made from any material, such as a ceramic or metal material, that is able to retain its shape without deforming to such an extent that the core portion 54 gets extruded through the fluid port. In one embodiment, the core portion 54 is made from one or more relatively hard materials (i.e., harder than the outer portion material), Examples of such material include metal (e.g., steel or aluminum), ceramic, cement and degradable materials such as degradable metal or metal alloys. The core material has a size and a compressive strength so that the core portion can withstand applied pressures (e.g., 10,000 psi of differential) without extruding it through fluid passages.

The outer portion 56 includes one or more materials (e.g., layers) that are softer than the core portion 54 and the fluid ports 22. For example, the outer portion 56 includes one or more layers of softer (malleable) material that deforms and creates a seal around a fluid port or ports 22 when in engagement therewith. The outer diameter or size of the plug 50, as defined by the outer portion 56, is selected to have a surface area that is large enough to provide floatability in the fluid that carriers the plug 50.

The outer portion 56 may be made from any deformable material suitable for use in a downhole or subterranean environment. The material(s) making up the outer portion may be made from materials such as rubber, synthetic rubber, plastic (polymer) and others. In one embodiment, the core material is a degradable or dissolvable polymer.

In one embodiment, all or part of the plug 50 is made from a degradable material. For example, both the core portion 54 and the outer portion 56 are made from degradable materials, such as those discussed above. The degradable materials may degrade in response to some activation mechanism (e.g., an activation fluid) and/or be configured to degrade over time. In this embodiment, after the plug 50 engages, the materials making up the plug degrade so that fluid obstruction is eventually removed.

Although only two portions are shown, the plug 50 may have multiple portions having different properties. For example, the plug 50 can have multiple outer layers having different properties such as hardness and/or degradability.

The core portion 54 may have a spherical or generally spherical overall shape as shown in FIG. 3, or a non-spherical shape. For example, referring to FIG. 4, the core portion 54 has an ovoid or other elongated shape (e.g., cylinder, rod, bar, etc.). The elongated shape of the core portion 54, in one embodiment, is an oval shape or other shape that has a size that tapers or otherwise is reduced at the ends relative to the center. The elongated shape allows the core portion 54, in some instances, to partially extend into a fluid port 22 or other fluid passage to enhance sealing.

Figure 4:
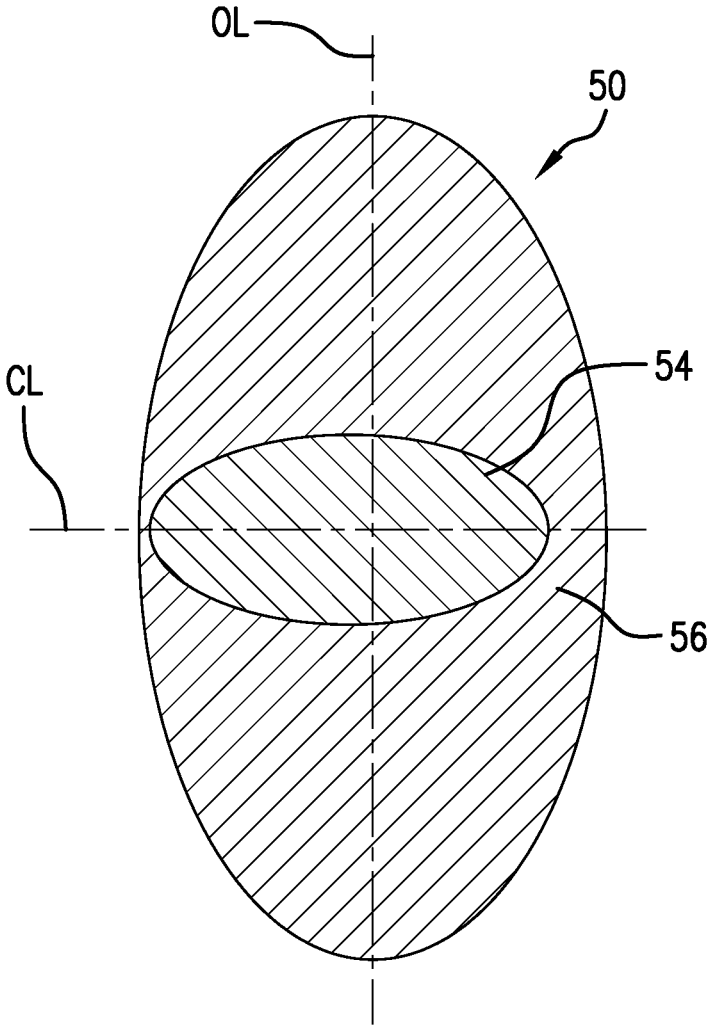
FIG. 4 depicts an embodiment of a deployable body having a core portion and an outer portion, the core portion and outer portion having unaligned longitudinal axes.

In the example of FIG. 4, the plug 50 includes an elongated (e.g., oval) shape having a first longitudinal axis $C_L$. The outer portion may be spherical or ball-shaped, or may also be elongated. For example, the outer portion 54 has a second longitudinal axis $O_L$ that is unaligned with the first longitudinal axis $C_L$ has a different direction than the first longitudinal axis $C_L$, i.e., the axes are not in alignment. The axes may be perpendicular as shown in FIG. 4, but can have any suitable orientation.

Thus, in one embodiment, the plug 50 includes an elongated core portion 54 that is orthogonal to, or otherwise unaligned with, an elongated outer portion 56. The elongated core portion 54 may also be shorter than the elongated outer portion 56. The core portion 54 is denser and harder than the outer portion 56, or otherwise has a different property than the outer portion 56.

The unaligned configuration and the width of the core portion 54, in some cases, causes the core portion 54 to protrude into a fluid port 22. For example, the core portion 54 can be caused to align the shorter axis CL perpendicularly to the fluid port when the softer outer portion is against the fluid port 22.

Figure 5:
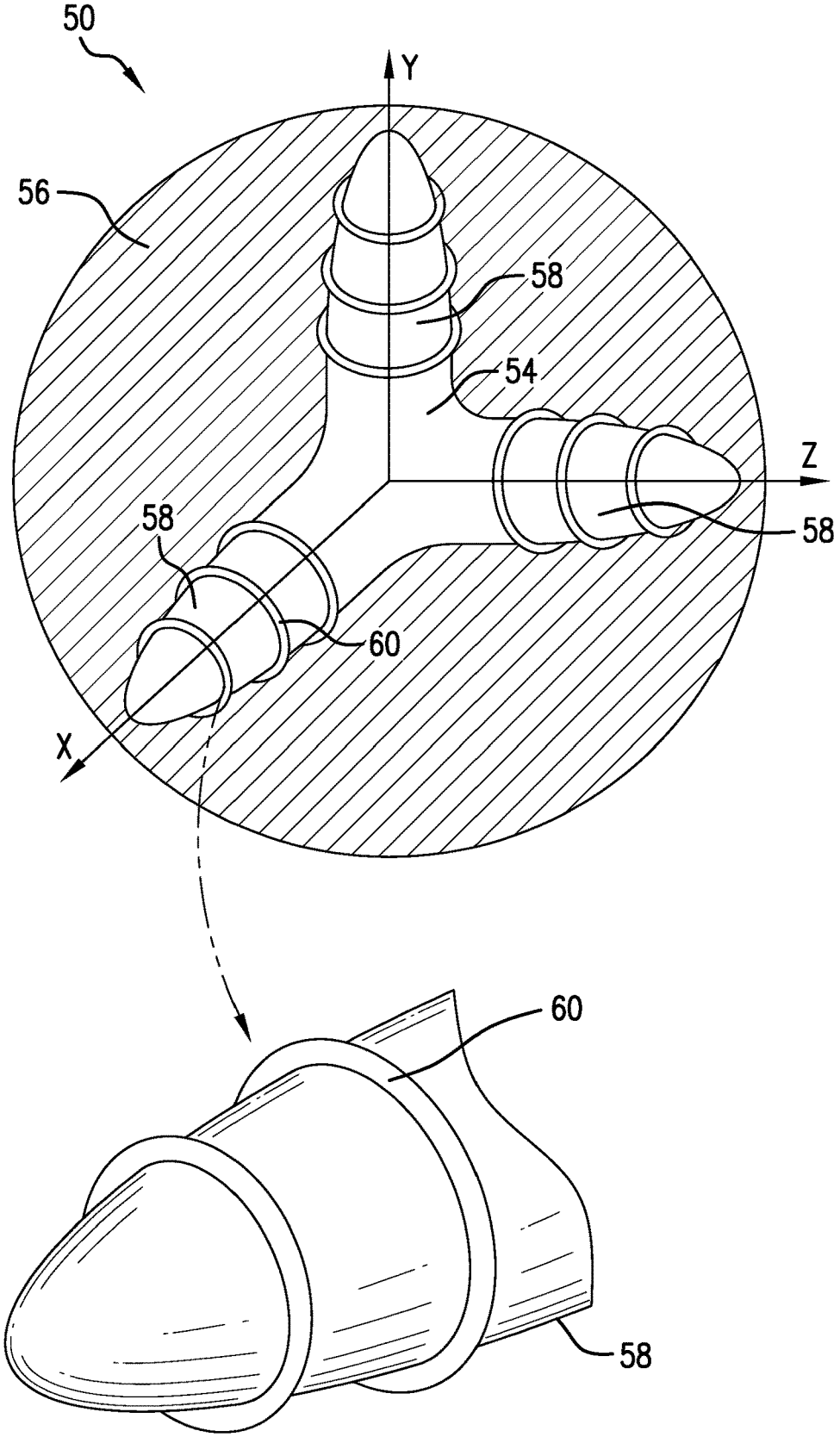
FIG. 5 depicts an embodiment of a deployable body having a core portion and an outer portion, the core portion including one or more engagement features.

The core portion can 54 have a variety of sizes, shapes and overall forms. In one embodiment, the core portion 54 includes engagement features configured to enhance the ability of the plug 50 to engage with fluid passages and block or restrict flow. For example, referring to FIG. 5, the core portion 54 includes one or more engagement features in the form of one or more protrusions 58. In the example of FIG. 5, the core portion includes three protrusions, each having an elongated axis. The protrusions may be normal to each other as shown in FIG. 5, in which the protrusions have orthogonal axes x, y and z, or have another configuration or relative alignnment. At least part of each protrusion 58 has a diameter or size selected so that a protrusion can extend into a fluid passage when the plug is in engagement with the fluid passage. For example, each protrusion has a tapered shape that reduced in width towards an end of the protrusion.

Another example of an engagement feature is shown in FIG. 5 as one or more anchoring ribs 60 or other features on the protrusions 58. The anchoring ribs 60 help to facilitate engagement with a fluid passage when the core portion 54 is brought into contact or brought proximate to the fluid passage. The anchoring ribs 60 may be part of the inner core material or made from a harder material than the rest of the core portion 54 (e.g., a harder duro rubber).

Figure 6:
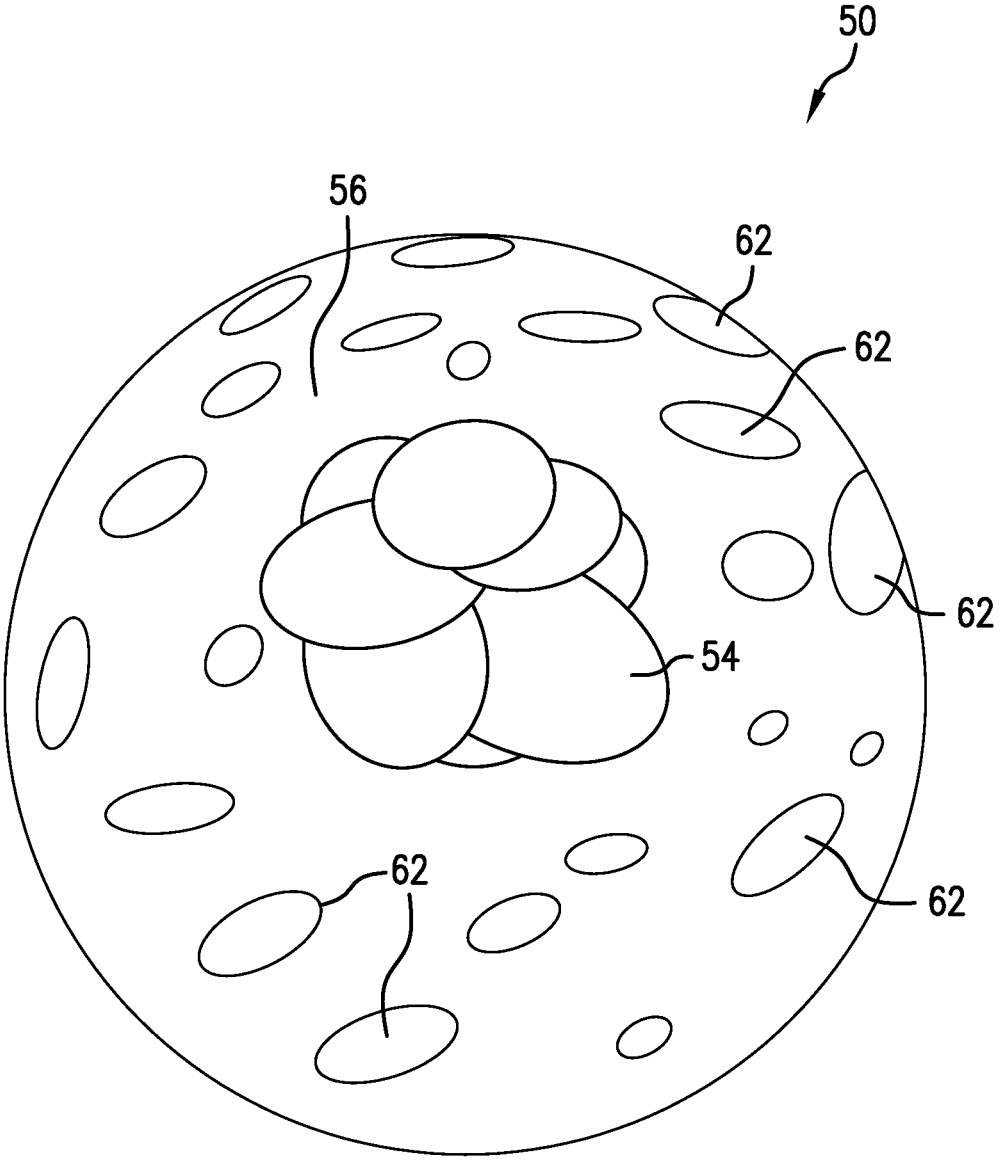
FIG. 6 depicts an embodiment of a deployable body having a core portion and an outer portion, the outer portion having a plurality of features for facilitating transport by fluid.

In one embodiment, the outer portion 56 includes one or more features configured to increase the ability of fluid to carry the plug 50. For example, as shown in FIG. 6, the outer portion 56 includes a plurality of divots 62, which increase the surface area and increase the ability for fluid to move the plug 50. It is noted that the outer portion 56 is not limited to the examples described herein, and can have any type or number of features. FIG. 6 also shows an example of the core portion 54 in which the core portion 54 has a non-spherical and/or irregular shape.

Figure 7:
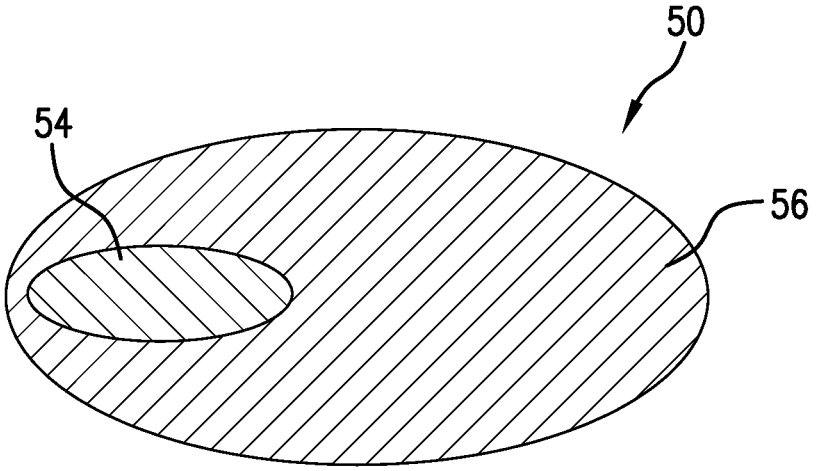
FIG. 7 depicts an embodiment of a deployable body having a core portion and an outer portion, the core portion eccentrically arranged relative to the outer portion.

In one embodiment, the core portion 54 is eccentrically arranged relative to the outer portion 56. Referring to FIG. 7, for example, the core portion is not centrally located, but rather is located closer to an end or surface of the outer portion. The core portion 54 and the outer portion 56 may be elongated, and aligned as shown in FIG. 7, or unaligned.

Figure 8:
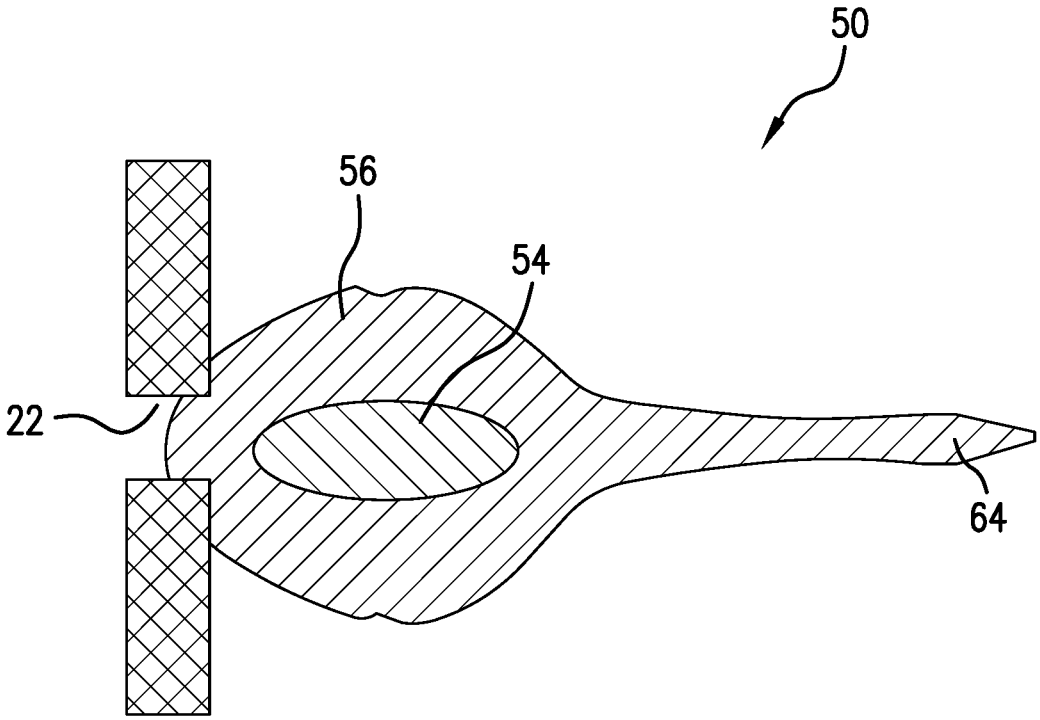
FIG. 8 depicts an embodiment of a deployable body having a core portion and an outer portion, the outer portion having a fluid dynamic tail for facilitating transport of the deployable body via fluid.

FIG. 8 depicts another example of the plug 50, in which the outer portion 56 has a feature configured to facilitate transport of the plug 50 by fluid. In this example, the outer portion 56 includes an elongated tail 64 that protrudes from an end of the outer portion. The tail 64 may be flat or at least have surfaces that provide additional surface area for fluid transport. In addition, as shown, when the plug 50 is drawn into engagement with a fluid passage (e.g., a fluid port 22), fluid flow in a production conduit or other fluid conduit forces the plug 50 to engage with the fluid passage so that the elongated core portion 54 is at least partially perpendicular to a wall of the production conduit. This allows the core portion 54 to protrude into the fluid passage as the outer portion deforms against the wall and the fluid passage.

Figure 9:
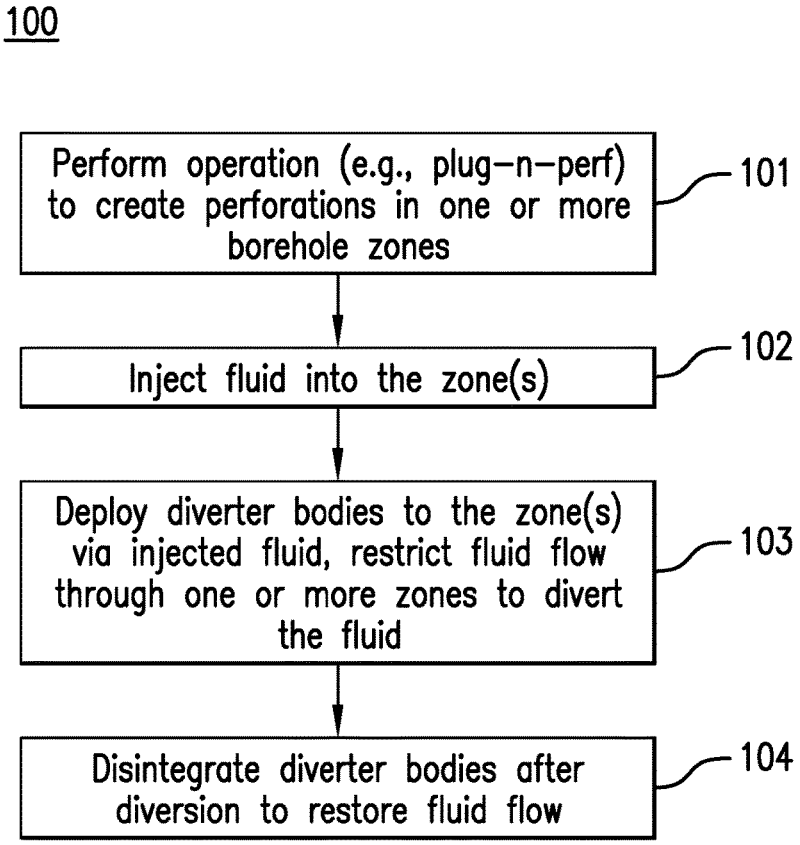
FIG. 9 is a flow diagram representing an embodiment of a method of performing a subterranean operation that includes diverting fluid.

FIG. 9 illustrates a method 100 for performing a subterranean operation that includes injecting a fluid such as a stimulation fluid into a borehole. In one embodiment, the method 100 includes a hydraulic fracturing operation, but is not so limited. The method 100 includes one or more stages represented by blocks 101-104. In one embodiment, the stages are performed in the order described, although some stages may be performed in a different order or one or more steps may be omitted.

The method 100 is discussed for illustration purposes in conjunction with the system 10 of FIG. 1, but can be used in any of a variety of systems and operations. The method 100 is also discussed with reference to FIG. 10, which shows an example of the plug 50 having elongated, unaligned core and outer portions. It is noted that the method can be used with any of various masses or objects of different types, sizes, shapes and material compositions.

In the first stage 101, one or more zones or sections of a borehole such as the borehole 12 are selected for stimulation, e.g., using various open hole logging operations. In one embodiment, after zones of interest are found, casing 20 is run into the borehole 12 and cemented. Fluid passages, such as the fluid ports 22, may be established by predesigned passages formed in the casing wall, or a tool (e.g., a perforating gun) can be deployed to perforate the casing and form the fluid ports 22, In the second stage 102, stimulation fluid is circulated by injecting a stimulation fluid such as a fracturing slurry into a fluid conduit, such as a production conduit established by the borehole string 12 and the casing 20. Fractures are created and/or extended (e.g., in width and/or length) by pumping fluid into the production conduit and into a subterranean region via fluid passages such as the fluid ports 22.

Stress conditions in the borehole 12 can be altered by diverting fluid flow such that fluid pumped into a formation will more readily flow into less conductive secondary fractures within the formation. Diversion limits injectivity in the primary fractures and stress pressures within the formation. Accordingly, fluid flow can be diverted from a high permeability zone to a low permeability zone. For example, high permeability zones may be due to highly conductive primary fracture(s), and low permeability zones may be due to less conductive secondary fractures. Alteration of the local stress conditions provides greater complexity to the created fracture network and/or improves the reservoir coverage of the stimulation treatment.

In the third stage 103, one or a plurality of deployable bodies, such as the plugs 50, are deployed into the borehole to divert fluid from high permeability regions (where fluid is injected into the regions with a high flow rate) to lower permeability regions. The relatively high flow rate of fluid flowing into the high permeability regions draws the plugs into engagement with fluid ports 22 and/or clusters 24 in fluid communication with the regions. As a result, fluid ports 22 in highly conductive zones or regions are plugged and fluid is diverted to less conductive zones or regions.

Figure 10A:
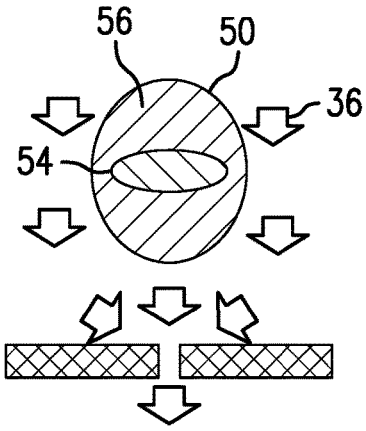
FIGS. 10A-10C (collectively referred to as "Figure 10") illustrates an example of a deployable body and engagement between the deployable body and a fluid passage, in accordance with the method of FIG. 9.
Figure 10B:
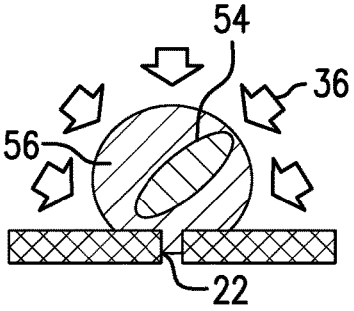
Figure 10C:
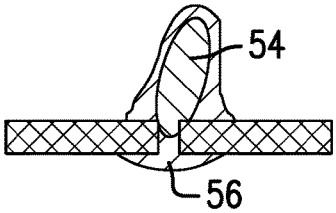

Referring to the example of FIG. 10, each plug 50 flows with stimulation fluid 36, and one or more of the plugs 50 are drawn into engagement with respective fluid ports. As shown in FIG. 10A, the elongated outer surface 56 aligns with the direction of fluid flow as the plug 50 approaches a fluid port 22. At this point, the elongated core portion 54 is generally perpendicular to a fluid conduit surface at the fluid port. As shown in FIG. 10B, the outer surface begins to deform due to differential pressure, and is at least partially extruded into the fluid port 22. As the outer portion deforms and is extruded, the core portion 54 is pulled into at least partial alignment with the fluid port 22 so that the core portion 54 protrudes into the fluid port 22 (FIG. 10C).

In the fourth stage 104, in one embodiment, the plugs 50 are made from degradable or dissolvable materials, so that the plugs 50 can permit fluid flow into the previously fluid ports at some later time. Once the diversion is complete, the plugs 50 disintegrate to re-establish fluid flow to the previously restricted regions. In addition, degradation or disintegration of the plugs 50 facilitates subsequent operations (e.g., milling interventions), in that no obstacles are left in the production conduit. The materials may degrade in response to some activation mechanism (e.g., an activation fluid) and/or degrade over time.

The plugs 50 may be made from degradable materials that dissolve, degrade or otherwise disintegrate at different rates. For example, the core portion 54 may be made from a material that degrades at a slower rate than the material making up the outer portion 56.

It is noted that the plugs can be used in various operations, in addition to or in place of a stimulation operation. For example, plugs 50 or other deployable objects as described herein can be used in subsequent re-fracturing operations.

Set forth below are some embodiments of the foregoing disclosure:

Embodiment 1: A system for diverting fluid in a borehole string, comprising: an object configured to be deployed in the borehole string, the borehole string including a plurality of fluid ports defining a plurality of zones along a length of the borehole string, each fluid port extending from a fluid conduit in the borehole string to at least one of: an annular region of the borehole string and a subterranean region, the object configured to be advanced by a fluid to a fluid port to obstruct the fluid port and divert the fluid in the borehole string to another fluid port, the object including: a core portion made from a first material having a first property; and an outer portion at least partially surrounding the core portion and made from a second material, the second material being deformable and having a second property that is different than the first property.

Embodiment 2: The system of any prior embodiment, wherein the borehole fluid is a stimulation fluid configured to be pumped through one or more fluid ports into the subterranean region to stimulate the subterranean region.

Embodiment 3: The system of any prior embodiment, wherein the object is configured to be drawn by the stimulation fluid to a fluid port in a zone having a high flow rate, to restrict fluid flow through the zone and divert the fluid flow to another zone having a low fluid flow rate.

Embodiment 4: The system of any prior embodiment, wherein the outer portion is configured to conform to a shape of the fluid port when the object is drawn to the fluid port.

Embodiment 5: The system of any prior embodiment, wherein the core portion is made from a rigid material configured to maintain a shape of the core portion during engagement with the fluid port.

Embodiment 6: The system of any prior embodiment, wherein the first property is a hardness and/or a density, the hardness and/or the density of the core portion being greater than the outer portion.

Embodiment 7: The system of any prior embodiment, wherein the first material and the second material are degradable.

Embodiment 8: The system of any prior embodiment, wherein the core has a first elongated shape and is made from a rigid material configured to maintain the first elongated shape during engagement with the fluid port, and the outer portion has a second elongated shape, the first elongated shape being unaligned with the second elongated shape.

Embodiment 9: The system of any prior embodiment, wherein the core portion is eccentrically located within the outer portion.

Embodiment 10: The system of any prior embodiment, wherein the outer portion has a shape that includes an elongated tail configured to bias the object toward the fluid port.

Embodiment 11: A method of diverting fluid in a borehole string, comprising: injecting a fluid into a fluid conduit of the borehole string, the borehole string including a plurality of fluid ports defining a plurality of zones along a length of the borehole string, each fluid port extending from a fluid conduit in the borehole string to at least one of: an annular region of the borehole string and a subterranean region, wherein the injecting includes flowing the fluid through one or more fluid ports into the subterranean region; and deploying an object into the borehole string and advancing the object by the fluid to a fluid port to obstruct the fluid port and divert the fluid in the borehole string to another fluid port, the object including: a core portion made from a first material having a first property, and an outer portion at least partially surrounding the core portion and made from a second material, the second material being deformable and having a second property that is different than the first property.

Embodiment 12: The method of any prior embodiment, wherein the borehole fluid is a stimulation fluid pumped through one or more fluid ports into a formation to stimulate the formation.

Embodiment 13: The method of any prior embodiment, wherein deploying the object includes drawing the object via the fluid to a fluid port in a zone having a high flow rate, to restrict fluid flow through the zone and divert the fluid flow to another zone having a low fluid flow rate.

Embodiment 14: The method of any prior embodiment, wherein the outer portion is configured to conform to a shape of the fluid port when the object is drawn to the fluid port.

Embodiment 15: The method of any prior embodiment, wherein the core portion is made from a rigid material configured to maintain a shape of the core portion during engagement with the fluid passage.

Embodiment 16: The method of any prior embodiment, wherein the first property is a hardness and/or a density, the hardness and/or the density of the core portion being greater than the outer portion.

Embodiment 17: The method of any prior embodiment, wherein the first material and the second material are degradable, the method further comprising degrading the material to permit fluid flow through the fluid port.

Embodiment 18: The method of any prior embodiment, wherein the core has a first elongated shape and is made from a rigid material configured to maintain the first elongated shape during engagement with the fluid passage, and the outer portion has a second elongated shape, the first elongated shape being unaligned with the second elongated shape.

Embodiment 19: The method of any prior embodiment, wherein the core portion is eccentrically located within the outer portion.

Embodiment 20: The method of any prior embodiment, wherein the outer portion has a shape that includes an elongated tail configured to bias the object toward the fluid port.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for diverting fluid in a borehole string, comprising:

an object configured to be deployed in the borehole string, the borehole string including a plurality of fluid ports defining a plurality of zones along a length of the borehole string, each fluid port extending from a fluid conduit in the borehole string to at least one of: an annular region of the borehole string and a subterranean region, the object configured to be advanced by a fluid to a fluid port to obstruct the fluid port and divert the fluid in the borehole string to another fluid port, the object including:

a core portion made from a first material having a first property; and an outer portion at least partially surrounding the core portion and made from a second material, the second material being deformable and having a second property that is different than the first property, wherein the core portion has a first elongated shape having a first longitudinal axis, and the outer portion has a second elongated shape having a second longitudinal axis, the first longitudinal axis being unaligned with the second longitudinal axis.

2. The system of claim 1, wherein the borehole fluid is a stimulation fluid configured to be pumped through one or more fluid ports into the subterranean region to stimulate the subterranean region.

3. The system of claim 2, wherein the object is configured to be drawn by the stimulation fluid to a fluid port in a zone having a high flow rate, to restrict fluid flow through the zone and divert the fluid flow to another zone having a low fluid flow rate.

4. The system of claim 1, wherein the outer portion is configured to conform to a shape of the fluid port when the object is drawn to the fluid port.

5. The system of claim 4, wherein the core portion is made from a rigid material configured to maintain a shape of the core portion during engagement with the fluid port.

6. The system of claim 1, wherein the first property is a hardness and/or a density, the hardness and/or the density of the core portion being greater than the outer portion.

7. The system of claim 1, wherein the first material and the second material are degradable.

8. The system of claim 1, wherein the core portion is made from a rigid material configured to maintain the first elongated shape during engagement with the fluid port, and the outer portion is made from a material configured to be at least partially extruded into the fluid port during engagement with the fluid port.

9. The system of claim 8, wherein the core portion is eccentrically located within the outer portion.

10. The system of claim 1, wherein the outer portion has a shape that includes an elongated tail configured to bias the object toward the fluid port.

11. A method of diverting fluid in a borehole string, comprising:

injecting a fluid into a fluid conduit of the borehole string, the borehole string including a plurality of fluid ports defining a plurality of zones along a length of the borehole string, each fluid port extending from a fluid conduit in the borehole string to at least one of: an annular region of the borehole string and a subterranean region, wherein the injecting includes flowing the fluid through one or more fluid ports into the subterranean region; and deploying an object into the borehole string and advancing the object by the fluid to a fluid port to obstruct the fluid port and divert the fluid in the borehole string to another fluid port, the object including: a core portion made from a first material having a first property, and an outer portion at least partially surrounding the core portion and made from a second material, the second material being deformable and having a second property that is different than the first property, wherein the core portion has a first elongated shape having a first longitudinal axis, and the outer portion has a second elongated shape having a second longitudinal axis, the first longitudinal axis being unaligned with the second longitudinal axis.

12. The method of claim 11, wherein the borehole fluid is a stimulation fluid pumped through one or more fluid ports into a formation to stimulate the formation.

13. The method of claim 12, wherein deploying the object includes drawing the object via the fluid to a fluid port in a zone having a high flow rate, to restrict fluid flow through the zone and divert the fluid flow to another zone having a low fluid flow rate.

14. The method of claim 11, wherein the outer portion is configured to conform to a shape of the fluid port when the object is drawn to the fluid port.

15. The method of claim 14, wherein the core portion is made from a rigid material configured to maintain a shape of the core portion during engagement with the fluid port.

16. The method of claim 11, wherein the first property is a hardness and/or a density, the hardness and/or the density of the core portion being greater than the outer portion.

17. The method of claim 11, wherein the first material and the second material are degradable, the method further comprising degrading the material to permit fluid flow through the fluid port.

18. The method of claim 11, wherein the core portion is made from a rigid material configured to maintain the first elongated shape during engagement with the fluid port, and the outer portion is made from a material configured to be at least partially extruded into the fluid port during engagement with the fluid port.

19. The method of claim 18, wherein the core portion is eccentrically located within the outer portion.

20. The method of claim 11, wherein the outer portion has a shape that includes an elongated tail configured to bias the object toward the fluid port.

* * * * *